United States Patent [19]

Procter et al.

[11] 4,091,749

[45] May 30, 1978

[54] ALKALINE PULPING OF LIGNOCELLULOSIC MATERIAL WITH AMINE PRETREATMENT

[75] Inventors: Alan Robert Procter; Wayne Ming Chow, both of Vancouver, Canada

[73] Assignee: MacMillan Bloedel Limited, Vancouver, Canada

[21] Appl. No.: 734,184

[22] Filed: Oct. 20, 1976

Related U.S. Application Data

[63] Continuation-in-part of Ser. No. 538,116, Jan. 2, 1975, abandoned.

[51] Int. Cl.[2] ..... D21C 1/00

[52] U.S. Cl. ..... 162/25; 162/65; 162/72; 162/90

[58] Field of Search ..... 162/25, 63, 65, 72, 162/90; 8/111; 241/15, 17, 18, 21, 27, 28

[56] References Cited

U.S. PATENT DOCUMENTS

| | | | |
|---|---|---|---|
| 2,218,479 | 10/1940 | Peterson et al. | 162/72 X |
| 2,668,110 | 2/1954 | Spencer et al. | 162/72 X |
| 3,520,773 | 7/1970 | Vinje et al. | 162/63 |
| 3,691,008 | 9/1972 | Worster et al. | 162/65 X |
| 3,695,994 | 10/1972 | Worster et al. | 162/65 |
| 3,829,357 | 8/1974 | Thompson et al. | 162/65 X |
| 3,951,732 | 4/1976 | Sjostrom et al. | 162/65 |

*Primary Examiner*—Arthur L. Corbin

[57] ABSTRACT

A lignocellulosic material, such as wood chips, is pretreated with an aqueous solution containing from 0.1 to 10% by weight of a water soluble lower aliphatic amine selected from monoethanolamine, methylamine and dimethylamine, at elevated temperature and pressure in a closed vessel. This pretreated material is then subjected to conventional soda or two-stage soda-oxygen pulping.

11 Claims, No Drawings

ALKALINE PULPING OF LIGNOCELLULOSIC MATERIAL WITH AMINE PRETREATMENT

This application is a continuation-in-part of Ser. No. 538,116, filed Jan. 2, 1975, now abandoned.

BACKGROUND OF THE INVENTION (a) Field of the Invention

This invention relates to an amine pretreatment for increasing the yield or quality of pulp obtained from an alkaline pulping process.

(b) Description of the Prior Art

Until very recently, the only practical method for producing high strength chemical pulp from lignocellulosic material such as wood chips, was by the old established kraft process. In this process, lignocellulosic material is cooked in an aqueous solution containing NaOH and $Na_2S$. This process, however, suffers from two disadvantages, namely a relatively low pulp yield, and odorous gas emissions — the latter arising from the use of sulfur compounds in the kraft cooking liquors. Both of these process aspects have become more critical in recent years with the rising production costs, raw material shortages, and the public pressures for a cleaner environment with less pollutive mill emissions. A number of methods for improving kraft pulp yield have been proposed, but the only processes of practical significance involve the use of sodium polysulfide as described in the text "The Pulping of Wood", R. G. MacDonald, Editor, McGraw-Hill, or $H_2S$ as described in Vinje and Worster, U.S. Pat. No. 3,520,773, issued July 14, 1970. Both of these process changes, however, do not avoid the use of sulfur in the kraft mill and consequently kraft mill odor remains a problem.

Practical methods to avoid the use of sulfur in chemical pulp mills have long been sought after by the Pulp and Paper Industry. The soda and recently discovered two-stage soda-oxygen processes are the only processes currently available for producing high quality chemical pulp without the use of sulfur. The soda process is little used because it produces pulp of lower yield and quality compared to the kraft process. The soda-oxygen process, as described in Worster and Pudek, U.S. Pat. No. 3,691,008, issued Sept. 12, 1972, avoids these deficiencies, and produces a pulp of comparable yield and quality to the kraft process. It is a principal purpose of this invention to provide a method for pulping to even higher yields than the soda-oxygen or kraft processes without using sulfur-containing compounds.

It has also been known for many years that aliphatic amine compounds can be used as a pulping agent either alone or in combination with known alkaline pulping agents. As described in Peterson and Wise, U.S. Pat. No. 2,218,479, issued Oct. 15, 1940, a minimum of 15% by weight of the amine compound was required in the pulping liquor, with 70–100% being preferred. This apparently improves pulp yields and pulp quality.

SUMMARY OF THE INVENTION

According to the present invention it has surprisingly been determined that superior yields can be obtained with smaller amine applications if certain selected water soluble, lower aliphatic amines are used to pretreat lignocellulosic materials, followed by an alkaline pulping process.

Thus, the present invention provides a method for increasing the yield or quality of pulp obtained from an alkaline pulping process, in which lignocellulosic material is first pretreated with an aqueous solution containing from 0.1 to 10% by weight of an aliphatic amine selected from monoethanolamine, methylamine and dimethylamine and thereafter subjecting the pretreated lignocellulosic material to alkaline digestion with sodium hydroxide alone at a sodium hydroxide application of at least 8% by weight expressed as sodium oxide based on the dry weight of the wood chips.

DESCRIPTION OF THE PREFERRED EMBODIMENTS

The pretreatment is preferably conducted at an amine solution (0.1 to 10%) to lignocellulosic material weight ratio of from 1:1 to 10:1 at a temperature of from 80° to 180° C for 5 to 120 minutes. It is advantageously conducted in a pressure vessel preferably at a pressure above the ambient steam pressure of from 0 to 200 psi. The latter pressure is preferably provided by an inert gas such as nitrogen which does not react substantially with the pretreatment chemicals.

It is also desirable to adjust the pH of the aqueous amine pretreatment solution to a cold pH in the range of 8 to 13 by addition of alkali. Preferably sodium hydroxide is added as alkali in an amount of from 0.2 to 10% by weight based on the dry weight of lignocellulosic material. Sodium carbonate can also be used as the alkali.

The alkaline digestion can also advantageously be in the form of a two-stage soda-oxygen pulping such as that described in U.S. Pat. No. 3,691,008, the disclosure of which is incorporated herein by reference.

As an example of the unexpected advantages of the invention, it has been found that when monoethanolamine is used as an additive in a conventional soda cook, yields equivalent to the kraft or soda-oxygen process can be obtained only at very high amine applications of about 20% on wood. At this high application of amine, a yield increase of about 4% was obtained over equivalent soda pulping yields of the same lignin content. This is illustrated by Table I below:

TABLE I

| | | | |
|---|---|---|---|
| % Monoethanolamine on wood | 20 | 10 | 5 |
| Yield comparison with soda-oxygen at same lignin content | same | −0.8 | −1.5 |
| Yield increase over soda at same lignin content | 4 | 3.2 | 2.5 |

This is typical of the prior art systems such as those described in U.S. Pat. No. 2,218,479.

On the other hand, with the pretreatment method of the present invention, using only a 7% monoethanolamine on chips pretreatment, about a 6.3% yield increase over regular soda pulping or a 2.3% yield increase over comparable soda-oxygen pulp at the same lignin content is achieved. This is illustrated by the following Table II:

TABLE II

| | | | | |
|---|---|---|---|---|
| % Monoethanolamine pretreatment applied based on wood | 15 | 7 | 5 | 3 |
| Yield increase over soda-oxygen at same lignin content | 2.5 | 2.3 | 1.5 | 0.4 |

A monoethanolamine pretreatment combined with a soda-oxygen pulping scheme provided an even higher yield increase of about 4.5% (at the same lignin content) with a 7% monoethanol amine pretreatment. This is equivalent to a 8.5% yield increase over comparable soda pulp.

As a comparison of the effectiveness of various aliphatic amines, a series of pretreatments were conducted at 7.0% amine (on wood) followed by conventional soda pulping. The yield increases are set out in Table III below:

TABLE III

| Amine | Yield Increase over Soda |
|---|---|
| Monoethanolamine | 6.3% |
| Methylamine | 4.8% |
| Dimethylamine | 5.0% |
| Ethylenediamine | 2.3% |
| Trimethylamine | 2.6% |

Another advantage of this invention lies in the properties of pulps process by the amine pretreatment-soda-oxygen process. The quality of this high yield pulp is comparable to that of soda-oxygen or kraft pulps, and in particular has very high unbeaten burst and tensile strengths. This is illustrated by the following Table IV:

TABLE IV

| Strength Properties Unbeaten/500 CSF | Monoethanolamine Soda-Oxygen | Soda-Oxygen | Kraft |
|---|---|---|---|
| Burst Factor | 50/86 | 30/90 | 34/91 |
| Tear Factor | 156/91 | 280/108 | 316/126 |
| Tensile | 6.8/11.7 | 4.7/9.7 | 5.6/12.2 |
| Bulk | 2.04/1.50 | 1.97/1.49 | 2.05/1.47 |

Pulp having the above characteristics is excellent for linerboard and newsprint manufacture.

In the pretreatment, it has been found that pH and wood chip penetration of the amine are important factors controlling the efficiency of the pulping process. Penetration factors are, of course, less important with other types of lignocellulosic raw material such as sawdust, grasses, bagasse, etc. To aid chemicals penetration into the wood chips, the chips are first presteamed as in standard commercial practice, and an overpressure of an inert gas such as nitrogen is applied in the pretreatment stage.

The use of gasses other than nitrogen do not have a significant effect on the pulp yield. For example, with a 7% monoethanolamine pretreatment, yield increases with various gases are set out in Table V below:

TABLE V

| Gas Used | % Yield Increase Over Soda |
|---|---|
| Nitrogen | 4.2 |
| Air | 4.1 |
| Helium | 3.9 |
| Carbon Dioxide | 3.5 |

In a typical mill procedure, wood chips are pretreated in a pressure vessel with a solution of monoethanolamine, methylamine or dimethylamine at an amine application of about 5–10% by weight based on bone dry wood, together with about 0.5–3% NaOH on wood. The liquor to wood weight ratio is sufficient to saturate the chips and is typically about 4–5:1. Treatment temperatures are usually about 120°–160° C with treatment times of about 30–60 minutes. A convenient nitrogen pressure is about 25 psi. After the treatment, the chips are drained to recover unused amine and the pretreated chips are subjected to a conventional pulping process.

Cooking conditions in the soda stage are typical of those employed in regular soda or soda-oxygen pulping schemes. Somewhat lower temperatures, in the range 150° to 170° C, may be advantageously used in the soda stage of the soda-oxygen process, or in a soda cook where linerboard pulps with a high lignin content are required.

Pulping conditions used in the oxygen stage of the soda-oxygen process are typical of those detailed in prior art for the soda-oxygen process or oxygen bleaching processes. Typically, blow or mechanically defibered pulp from the soda stage is treated with NaOH (1 to 10% on pulp depending on consistency) in the presence of oxygen between about 100 and 200 psi and at temperatures between about 80° and 130° C for time periods of between about 30 and 200 minutes. Pulp consistency during the oxygen treatment may range from 3 to 30%, and the presence of magnesium 'protector' compounds may be required as specified in the prior art.

In a typical pulp mill operation, the amine pretreatment can be carried out in a separate vessel with chip transfer to the cooking vessel, or the pretreatment can be carried out in the same vessel ahead of the cooking stage. In a continuous digester, the amine pretreatment can be carried out in the pre-impregnation zone with co-current or counter-current flows of cooking and pretreatment liquors. Useful amine compounds may also be recovered or regenerated for recycle from the spent cooking liquor (black liquor) by evaporation, steam stripping, liquid/liquid extraction, or lignin precipitation. Regenerated amine compounds may also be prepared by reaction of compounds stripped from black liquor with ammonia. Overall amine consumption is between about 0.5 & 3% based on wood depending mainly on the particular amine used, and efficiency of its recovery from the black liquor.

The amine pretreatment technique may also be applied ahead of a kraft cooking scheme to provide yield increases of at least 2% based on wood over comparable kraft pulps at the same kappa number. Higher yield increases can be obtained if the kraft cook is stopped at a high lignin content and followed by an oxygen 'prebleaching' stage in a similar manner as the soda-oxygen pulping scheme.

Although the above discussion refers only to sodium based pulping processes, it is to be understood that potassium or ammonium based pulping systems are equally as amenable to the amine treatments of this invention.

Additional benefits that can be obtained through the amine treatments described in this invention are a more uniform and brighter unbleached pulp. Compared to pulps prepared by the conventional soda process, pulps prepared by amine pretreatment always show a higher unbleached brightness and lower rejects or shive level at the same lignin content (or degree of pulping). These are important pulp quality considerations for linerboard and unbleached market pulp applications as well as from the aspect of easier bleachability. Bleaching yield from these pulps has been found to be exceptionally high compared to bleaching yield on conventional soda or kraft pulps. These results arise from the exceptional uniformity of these pulps and probably from the low degree of lignin condensation in the unbleached pulps. The ability of the amine treatments to improve pulp uniformity is also evident with the kraft pulping process. An amine pretreatment to the kraft process results in higher pulp yield as well as a more uniform pulp. Incorporation of amine in the pretreatment of the $H_2S$ pretreatment kraft process resulted in a pulp with no rejects at all. Improvement in pulp quality with respect to brightness, uniformity and bleachability are thus additional benefits that can be obtained through this invention.

The presence of an amine in the liquor system of a pulp mill also has the advantage of inhibiting corrosion and absorbing any trace of odorous acid gases such as $H_2S$.

The mechanism of the amine pretreatment system is not fully understood; however, it is thought that carbohydrates are partially stabilized in the pretreatment stage toward alkaline degradation in the cooking stage, through the formation of Schiff bases with the aldehydic end groups of wood polysaccharides, or perhaps through the formation of a reduced end group (J. Amer. Chem. Soc. 57;2554 (1935)). The presence of residual amine from the pretreatment stage in the soda cooking stage is thought to act as a radical scavenger thus restricting lignin condensation. The presence of condensed lignin requires more severe cooking conditions. Such a mechanism could promote further carbohydrate retention in the cooking stage. Analysis of several softwood pulps for carbohydrates have confirmed a retention of mannan containing hemicelluloses with pulping schemes involving monoethanolamine pretreatment as set out in Table VI below:

TABLE VI

| Cooking Process | % Mannan in Pulp | % Xylan in Pulp |
|---|---|---|
| Kraft | 5.0 | 4.4 |
| Monoethanolamine pretreated kraft | 8.0 | 3.6 |
| Monoethanolamine pretreated soda | 9.4 | 2.6 |
| Monoethanolamine pretreated soda-oxygen | 9.8 | 3.6 |

When about 7% amine is applied in the pretreatment, about half of this can be recovered and recycled by draining the chips. Useful amine compounds may also be recovered for recycle from the spent cooking liquor (black liquor) by evaporation, stream stripping, liquid/-liquid extraction or lignin precipitation. The overall amine consumption is about 2 to 3% based on wood.

The following examples will illustrate the various aspects of the invention described in this specification. Western hemlock commercial chips were used in all the examples except where otherwise specified. All pulping experiments were conducted in a 0.4 cu. ft. stationary digester with liquor circulation, on 2 lb. (bone dry) charges of wood chips. All cooks except where otherwise indicated were subjected to a 6-minute presteaming treatment at 15 psig; liquor to wood ratio was 4.5 to 1. Liquor to wood ratio during pretreatments was normally 4 to 1.

EXAMPLE 1 (PRIOR ART)

A series of soda cooks were conducted on Western hemlock chips under the conditions specified in Table VII with varying amounts of monoethanolamine (MEA) being added directly to the cooking liquor. The yield results show that the presence of MEA in the cooking liquor produces pulps at higher yields than the soda process alone. However, these increases in yield only start to become significant at high MEA applications in the order of 20%. The results also show that with increasing amounts of MEA the cooking rate, as indicated by the kappa number, is accelerated.

TABLE VII

| Cook # | 1 | 2 | 3 |
|---|---|---|---|
| Cooking Conditions | | | |
| MEA added, % on wood | 5 | 10 | 20 |
| % NaOH on wood | 26 | 26 | 26 |
| Temperature, ° C | 170 | 170 | 170 |
| Time to Temp., min. | 90 | 90 | 90 |
| Time at Temp., min. | 120 | 120 | 120 |
| Results | | | |
| Kappa number | 54 | 47 | 37 |
| % Total Yield | 44.4 | 43.9 | 43.3 |
| % Rejects | 0.2 | 0.2 | 0.5 |
| % Total Yield Increase Over Soda at same Kappa # | 2.5 | 3.2 | 3.8 |
| Tappi Brightness | 21.1 | 21.7 | 25.3 |

EXAMPLE 2

Using similar conditions to those in Example 1, a modified procedure was carried out in which MEA was applied in the soda liquor during the warm-up period, after which the excess liquor was drained and the cook was continued with a low liquor to wood ratio similar to vapor phase digestion. The results, as set out in Table VIII, show that substantially less MEA is used in the cooking stage by this technique to obtain similar yields compared with the simple addition procedure used in Example 1.

The excess drained liquor from the preimpregnation step can be recycled and reused for further treatments. These results show that less active alkali is needed to cook to a given kappa number with the low liquor to wood ratios.

TABLE VIII

| Cook # | 4 | 5 |
|---|---|---|
| Cooking Conditions | | |
| MEA carried over to cooking stage, % on wood | 5.0 | 3.3 |
| Liquor to wood ratio | 2.5:1 | 3:1 |
| % NaOH on wood | 20.3 | 27.3 |
| Temperature, ° C | 170 | 170 |
| Time to Temp., min. | 90 | 90 |
| Time at Temp., min. | 120 | 120 |
| Results | | |
| Kappa number | 43 | 34 |
| % Screened Yield | 42.8 | 42.3 |
| % Rejects | 0.6 | 0.8 |
| % Total Yield Increase over soda at same Kappa # | 2.3 | 3.8 |
| Tappi Brightness | 25.6 | 30.4 |

EXAMPLE 3

A series of soda cooks were carried out, but utilizing the pretreatment method of the present invention. Thus, Western hemlock wood chips were first presteamed in the usual manner, but following presteaming the chips were given a pretreatment with an aqueous alkaline solution containing varying amounts of MEA prior to soda cooking. The pretreatment was carried out in the same 0.4 cu. ft. vessel as the soda cooking with an added nitrogen pressure of about 100 psi as measured at about 90° C after the presteaming treatment. At the end of the pretreatment, excess pretreatment liquor was removed from the digester and the pretreated chips were then subjected to a short water rinse. The rinse water was removed prior to charging the soda cooking liquor.

Pretreatment and cooking conditions together with results obtained are set out in Table IX. These results show that with the pretreatment technique of this invention, substantially better yields are obtained at much lower MEA applications than is possible by the MEA liquor addition technique of the prior art as illustrated in Example 1. They are also much superior to the yields obtained in Example 2. It was also found that with higher MEA applications in the pretreatment, a faster pulping rate resulted.

TABLE IX

| Cook # | 6 | 7 | 8 | 9 |
|---|---|---|---|---|
| Pretreatment Conditions | | | | |
| % MEA on wood | 3.0 | 5.0 | 7.0 | 15.0 |
| Liquor to wood ratio | 4.5/1 | 4.5/1 | 4.5/1 | 4.5/1 |
| % NaOH on wood | 1.0 | 1.0 | 1.0 | 1.0 |
| Max. Temperature, ° C | 140 | 140 | 140 | 140 |
| Time to Temp., min. | 45 | 45 | 45 | 45 |
| Time at Temp., min. | 60 | 60 | 60 | 60 |
| Digester pressure at temp., psig | 165 | 162 | 175 | 178 |
| Soda Stage Conditions | | | | |
| Liquor to wood ratio | 5.0/1 | 5.0/1 | 5.0/1 | 5.0/1 |
| % NaOH on wood | 26.0 | 26.0 | 26.0 | 26.0 |
| Max. Temperature, ° C | 170 | 170 | 170 | 170 |
| Time to Temp., min. | 15 | 15 | 15 | 15 |
| Time at Temp., min. | 120 | 120 | 120 | 120 |
| Results | | | | |
| Kappa number | 61.4 | 52.2 | 56.2 | 42.6 |
| % screened yield | 46.4 | 45.7 | 47.6 | 46.0 |
| % rejects | 0.7 | 1.3 | 0.7 | 0.2 |
| % total yield increase over soda at same Kappa # | 4.4 | 5.5 | 6.3 | 6.5 |
| Tappi brightness | 20.8 | 22.5 | 21.5 | 24.8 |

EXAMPLE 4

Following the same general procedure as set out in Example 3, a series of amine pretreatment-soda cooks were carried out utilizing methylamine (MA) and dimethylamine (DMA).

Pretreatment and cooking conditions together with results as shown in Table X. These indicate that pulping yields comparable to those of the kraft pulps and slightly lower than those of MEA-pretreated-soda pulps are obtained. However, these results are still superior to the results obtained by the prior art method as shown in Example 1.

TABLE X

| Cook # | 10 | 11 | 12 | 13 | 14 |
|---|---|---|---|---|---|
| Pretreatment Conditions | | | | | |
| Type of Amine | MA | MA | DMA | DMA | DMA |
| % Amine Applied on Wood | 7.0 | 7.0 | 7.0 | 10.0 | 15.0 |
| Liquor to Wood Ratio | 4.5/1 | 4.5/1 | 4.5/1 | 4.5/1 | 4.5/1 |
| % NaOH on Wood | 1.0 | 1.0 | 1.0 | 1.0 | 1.0 |

TABLE X-continued

| Cook # | 10 | 11 | 12 | 13 | 14 |
|---|---|---|---|---|---|
| Max. Temperature, ° C | 140 | 140 | 140 | 140 | 140 |
| Time to Temp., min. | .60 | 60 | 60 | 60 | 60 |
| Time at Temp., min. | 45 | 45 | 45 | 45 | 45 |
| Digester Pressure at Temp., psig | 173 | 168 | 171 | 180 | 200 |
| Soda Stage Conditions | | | | | |
| Liquor to Wood Ratio | 5.0/1 | 5.0/1 | 5.0/1 | 5.0/1 | 5.0/1 |
| % NaOH on Wood | 18.0 | 28.5 | 27.5 | 27.5 | 27.5 |
| Max. Temperature, ° C | 160 | 170 | 170 | 170 | 170 |
| Time to Temp., min. | 30 | 35 | 35 | 60 | 60 |
| Time at Temp., min. | 120 | 120 | 120 | 120 | 120 |
| Results | | | | | |
| Kappa No. | 153 | 43.9 | 48.0 | 55.9 | 43.5 |
| % Total Yield on Wood | 61.8 | 44.8 | 45.7 | 45.8 | 44.4 |
| % Total Yield Increase Over Soda at Same Kappa No. | 3.8 | 4.8 | 5.0 | 3.8 | 4.4 |
| Tappi brightness | 9.6 | 22.1 | 21.5 | 18.8 | 20.8 |

EXAMPLE 5

Again using generally similar conditions to those of Example 3, a further series of pretreatments were carried out using other amines and amine-like compounds. These pretreatments were all followed by regular soda pulping.

Pretreatment and cooking conditions together with results are shown in Table XI. All of the compounds studied were clearly less effective than MEA, MA or DMA for yield improvements.

TABLE XI

| Cook # | 15 | 16 | 17 | 18 | 19 | 20 |
|---|---|---|---|---|---|---|
| Pretreatment Conditions | | | | | | |
| Type of Amine Applied | Aniline | Ethylene-diamine | Trimethyl-amine | Benzyl-amine | Urea | Ammonia Gas |
| % Amine Applied on Wood | 7.0 | 7.0 | 7.0 | 7.0 | 7.0 | 12.5 |
| Liquor to Wood Ratio | 4.5/1 | 4.5/1 | 4.5/1 | 4.5/1 | 4.5/1 | 4.5/1 |
| % NaOH on Wood | 1.0 | 1.0 | 1.0 | 1.0 | 1.0 | 1.0 |
| Max. Temp., ° C | 140 | 140 | 140 | 140 | 140 | 140 |
| Time-to Temp, min | 60 | 60 | .60 | 60 | 60 | 60 |
| Time at Temp, min | 45 | 45 | 45 | 45 | 45 | 45 |
| Digester Pressure at Temp, psig | 175 | 176 | 180 | 176 | 180 | 169 |
| Soda Stage Conditions | | | | | | |
| Liquor to Wood Ratio | 5.0/1 | 5.0/1 | 5.0/1 | 5.0/1 | 5.0/1 | 5.0/1 |
| % NaOH on Wood | 28.5 | 22.0 | 27.5 | 27.5 | 20.0 | 28.5 |
| Max. Temp., ° C | 170 | 170 | 170 | 170 | 170 | 170 |
| Time to Temp, min | 35 | 35 | 35 | 35 | 35 | 35 |
| Time at Temp, min | 120 | 120 | 120 | 120 | 120 | 120 |
| Results | | | | | | |
| Kappa No. | 59.7 | 103 | 43.5 | 79.9 | 134.5 | 90.0 |
| % Total Yield on Wood | 44.5 | 52.2 | 42.6 | 47.3 | 55.5 | 48.4 |
| % Total Increase over Soda at Same Kappa No. | 1.0 | 2.3 | 2.6 | 1.3 | 0 | 0.6 |
| Tappi Brightness | — | — | 23.7 | — | 12.0 | — |

EXAMPLE 6

Following the same general procedure as was used in Example 3, a further series of MEA pretreatment-soda cooks were carried out at varying $N_2$ pressures during the pretreatment.

Pretreatment and cooking conditions together with results were shown in Table XII. These results show that increased nitrogen pressures are an aid to penetration of MEA into the center of the wood chips whereby increased yield improvements are obtained.

TABLE XII

| Cook # | 21 | 22 | 7 |
|---|---|---|---|
| Pretreatment Conditions | | | |

TABLE XII-continued

| Cook # | 21 | 22 | 7 |
|---|---|---|---|
| % MEA on wood | 7.0 | 7.0 | 7.0 |
| Liquor to wood ratio | 4.5 | 4.5 | 4.5 |
| % NaOH on wood | 1.0 | 1.0 | 1.0 |
| Max. Temperature, ° C | 140 | 140 | 140 |
| Time to Temp., min. | 45 | 45 | 45 |
| Time at Temp., min. | 60 | 60 | 60 |
| $N_2$ pressure after presteaming, psi | 0 | 25 | 109 |
| Digester press. at temp., psig | 52 | 85 | 175 |
| Soda Stage Conditions | | | |
| Liquor to wood ratio | 5.0 | 5.0 | 5.0 |
| % NaOH on wood | 26.0 | 26.0 | 26.0 |
| Max. Temperature, ° C. | 170 | 170 | 170 |
| Time to Temp., min. | 35 | 30 | 15 |
| Time at Temp., min. | 120 | 120 | 120 |
| Results | | | |
| Kappa number | 63.3 | 60.5 | 56.2 |
| % screened yield | 47.3 | 48.0 | 47.6 |
| % rejects | 0.4 | 0.6 | 0.7 |
| % total yield increase over soda at same Kappa # | 5.2 | 5.9 | 6.3 |
| Tappi brightness | 20.7 | 21.6 | 21.5 |

EXAMPLE 7

Again following the same general procedure as described in Example 3, a series of MEA pretreatment-soda cooks were carried out. The pretreatment conditions and soda cook conditions were identical to those in Example 3 except for the amounts of NaOH used in the pretreatment stage. These were varied to illustrate the effects of NaOH application in the pretreatment.

Pretreatment and cooking conditions together with results are shown in Table XIII and illustrate that small additions of NaOH are beneficial in the pretreatment. These results indicate that optimum results are obtained at an NaOH application of less than about 3% on wood.

TABLE XIII

| Cook # | 23 | 24 | 7 |
|---|---|---|---|
| Pretreatment Conditions | | | |
| % MEA on wood | 7.0 | 7.0 | 7.0 |
| % NaOH on wood | 0 | 1.0 | 3.0 |
| Results | | | |
| Kappa number | 45.0 | 56.2 | 62.3 |
| % screened yield | 44.4 | 47.6 | 46.0 |
| % rejects | 0.3 | 0.7 | 0.3 |
| % total yield increase over soda at same Kappa # | 5.3 | 6.3 | 4.1 |
| Tappi brightness | 21.8 | 21.5 | 20.0 |

EXAMPLE 8

A further series of MEA pretreatment-soda cooks were carried out under the same conditions as specified in Example 3 but with varying pretreatment times.

Pretreatment times and results obtained are set out in Table XIV. These results show that no advantages are obtained by pretreatment times greater than about 45 minutes.

TABLE XIV

| Cook # | 7 | 25 | 26 |
|---|---|---|---|
| Pretreatment Conditions | | | |
| % MEA on wood | 7.0 | 7.0 | 7.0 |
| Time at Temp., min. | 45 | 90 | 135 |
| Results | | | |
| Kappa number | 56.2 | 62.0 | 56.4 |
| % screened yield | 47.6 | 48.0 | 48.0 |
| % rejects | 0.7 | 0.6 | 0 |
| % total yield increase over soda at same Kappa # | 6.3 | 6.4 | 5.7 |
| Tappi brightness | 21.5 | 21.1 | 20.7 |

EXAMPLE 9

A series of MEA pretreatment-soda cooks were carried out using the same conditions as described in Example 3. All tests were carried out with 7% MEA on wood but with varying pretreatment temperatures.

The pretreatment temperatures and results obtained are shown in Table XV. These results indicate that there are substantially no benefits to be obtained by using pretreatment temperatures higher than about 140° C.

TABLE XV

| Cook # | 27 | 28 | 7 | 29 |
|---|---|---|---|---|
| Pretreatment Conditions | | | | |
| % MEA on wood | 7.0 | 7.0 | 7.0 | 7.0 |
| Temperature, ° C | 100 | 120 | 140 | 155 |
| Results | | | | |
| Kappa number | 52.8 | 50.7 | 56.2 | 54.6 |
| % screened yield | 46.1 | 46.2 | 47.6 | 48.4 |
| % rejects | 0 | 0 | 0.7 | 0 |
| % total yield increase over soda at same Kappa # | 4.6 | 5.0 | 6.3 | 6.4 |

EXAMPLE 10

In this test, a series of MEA chip pretreatments were combined with subsequent kraft pulping.

Western hemlock wood chips were first presteamed as usual and then pretreated with an aqueous alkaline solution containing 7% MEA on wood. The pretreatment was carried out in the same 0.4 cu. ft. digester as the cook with an added nitrogen pressure of about 100 psi as measured at about 90° C after the presteaming treatment. At the end of the pretreatment, excess pretreatment liquor was removed from the digester and the pretreated chips were then subjected to a short water rinse. The rinse water was removed prior to charging the kraft cooking liquor.

Pretreatment and cooking conditions together with results are shown in Table XVI. These results indicate an improved pulp yield over kraft pulping without the amine pretreatment.

TABLE XVI

| Cook # | 30 | 31 |
|---|---|---|
| Pretreatment Conditions | | |
| MEA added, % on wood | 7.0 | 7.0 |
| Liquor to wood ratio | 4.5/1 | 4.5/1 |
| % NaOH on wood | 0 | 1.0 |
| Temperature, ° C | 140 | 140 |
| Time to Temp., min. | 45 | 60 |
| Time at Temp., min. | 60 | 45 |
| Digester pressure at temp., psig | 178 | 180 |
| Kraft Stage Conditions | | |
| Liquor to wood ratio | 4.5/1 | 5.0/1 |
| % active alkali on wood, $Na_2O$ | 17.0 | 17.0 |
| Sulfidity | 25 | 21 |
| Max. Temp., ° C | 170 | 170 |
| Time to Temp., min. | 30 | 35 |
| Time at Temp., min. | 120 | 120 |
| Results | | |
| Kappa number | 32 | 32 |
| % screened yield | 45.4 | 44.8 |
| % rejects | 0.4 | 0.2 |
| % total yield increase over Kraft at same Kappa # | 2.0 | 1.6 |
| Tappi brightness | 25.8 | 25.3 |

EXAMPLE 11

In this example an MEA chip pretreatment was combined with a two-stage soda-oxygen pulping process.

Western hemlock wood chips were first presteamed as usual and then pretreated with an aqueous alkaline solution containing 7% MEA on wood. The pretreatment was carried out in the same 0.4 cu. ft. digester as the cook with an added nitrogen pressure of about 100 psi as measured at about 90° C after the presteaming treatment. At the end of the pretreatment, excess pretreatment liquor was removed from the digester and pretreated chips were then subjected to a short water rinse. The rinse water was removed prior to charging the soda cooking liquor.

After the pretreatment, soda cooking was carried out to a 135 Kappa number, the cooked chips were removed from the digester and then refined in a Sprout Waldron disc refiner. The refined pulp was then treated with oxygen under the conditions set out in Table XVII with the oxygen stage being carried out in a high pressure 'rocking' vessel with indirect electric heating.

Pretreatment and cooking conditions together with results are shown in Table XVII. These results show that very significant pulp yield increases over regular soda-oxygen or soda processes are obtained with the MEA pretreatment combined with a soda-oxygen pulping.

TABLE XVII

| Cook # | 32 | 33 |
|---|---|---|
| Pretreatment Conditions | | |
| MEA added, % on wood | 7.0 | 7.0 |
| Liquor to wood ratio | 4.5/1 | 4.5/1 |
| % NaOH on wood | 1.0 | 1.0 |
| Temperature, ° C | 140 | 140 |
| Time to Temp., min. | 60 | 60 |
| Time at Temp., min. | 45 | 45 |
| Digester pressure at temp., psig | 180 | 180 |
| Soda Stage Conditions | | |
| Liquor to wood ratio | 5.0/1 | 5.0/1 |
| % NaOH on wood | 18.0 | 18.0 |
| Temperature, ° C | 160 | 160 |
| Time to Temp., min. | 30 | 30 |
| Time at Temp., min. | 120 | 120 |
| Oxygen Stage | | |
| % $Na_2CO_3$ applied as $Na_2O$ | 10.0 | 9.0 |
| % consistency | 3.0 | 3.0 |
| $O_2$ pressure at 75° F, psig | 175 | 173 |
| Time to Temp., min. | 90 | 90 |
| Time at Temp., min. | 120 | 120 |
| Temperature, ° C | 115 | 120 |
| Results | | |
| Kappa number | 64.7 | 57 |
| % total yield | 52.6 | 51.3 |
| % total yield increase over soda at same Kappa # | 9.1 | 9.1 |

The MEA-soda-oxygen pulp is also evaluated for strength properties using a PFI mill and standard Tappi procedures. The results are shown in Table XVIII and these results indicate that pulp quality compares very favourably with typical pulps obtained by other processes of lower yield.

TABLE XVIII

| Pulping Process | MEA-Soda-$O_2$ | Soda | Soda-$O_2$ | Kraft |
|---|---|---|---|---|
| Unbeaten Properties | | | | |
| Freeness, CSF | 715 | 715 | 717 | 711 |
| Burst Factor | 50 | 22 | 30 | 34 |
| Tear Factor | 156 | 320 | 280 | 316 |
| Tensile, km | 6.8 | 3.4 | 4.7 | 5.6 |
| Bulk | 2.04 | 2.31 | — | 2.05 |
| Properties at 500/300 CSF | | | | |
| Burst Factor | 86/93 | 72/72 | 90/98 | 91/97 |
| Tear Factor | 91/85 | 98/94 | 108/98 | 126/113 |
| Tensile | 11.7/11.9 | 10.3/10.7 | 9.7/10.4 | 12.2/12.9 |
| Bulk | 1.50/1.44 | 1.47/1.42 | 1.49/1.43 | 1.47/1.41 |

EXAMPLE 12

Following the same general procedure as set out in Example 3, chips were pretreated with methylamine followed by a two-stage soda-oxygen pulping process. After the pretreatment, soda cooking was carried out to a 135 Kappa number.

Pretreatment and cooking conditions together with results are shown in Table XIX. These results again show a very significant pulp yield increase over regular soda-oxygen or soda processes when a methylamine pretreatment is used in combination with a soda-oxygen pulping procedure.

TABLE XIX

| Cook # | 34 |
|---|---|
| Pretreatment Conditions | |
| % MA applied on wood | 7.0 |
| Liquor to Wood Ratio | 4.5/1 |
| % NaOH on wood | 1.0 |
| Max. Temperature, ° C | 140 |
| Time to Temp., min. | 60 |
| Time at Temp., min. | 45 |
| Digester Pressure at Temp., psig | 165 |
| Soda Stage Conditions | |
| Liquor to Wood Ratio | 5.0/1 |
| % NaOH on Wood | 18.0 |
| Temperature, ° C | 160 |
| Time to Temp., min. | 30 |
| Time at Temp., min. | 120 |
| Oxygen Stage | |
| % NaOH Applied as $Na_2O$ | 6.0 |
| % Consistency | 3.0 |
| $O_2$ Pressure at 75° F, psig | 170 |
| Time to Temp, min. | 90 |
| Time at Temp., min | 90 |
| Temperature, ° C | 120 |
| Results | |
| Kappa No. | 43.6 |
| % Total Yield on Wood | 48.7 |
| % Total Yield Increase Over Soda at Same Kappa No. | 8.7 |

EXAMPLE 13

The methylamine pretreated soda pulp obtained in Example 12 was subjected to a conventional three-stage bleaching sequence. The chlorination, caustic extraction and hypochlorite bleach conditions and results thereof are all set out in Table XX. Also shown in the Table are bleaching conditions and results for a typical kraft pulp.

These results show that methylamine-pretreated soda pulp is approximately 2% higher bleached yield than that obtained from conventional kraft pulp. The high chlorine and caustic applications for the methylamine pretreated soda pulp is to adjust for the higher lignin content of this pulp. The results illustrate the improved bleachability of amine pretreated pulp, from which improved yields of bleached pulp are possible.

TABLE XX

| Type of Pulp | MA-Soda | Kraft |
|---|---|---|
| Chlorination Stage | | |
| $Cl_2$ Application as Available $Cl_2$ | 9.1 | 5.7 |
| Temperature, ° C | 21.0 | 21.0 |
| % Consistency | 2.0 | 2.0 |

TABLE XX-continued

| Type of Pulp | MA-Soda | Kraft |
|---|---|---|
| Time, min. | 50 | 60 |
| Residual Liquor pH | 1.6 | 1.8 |
| Caustic Extraction Stage | | |
| % NaOH on O.D. Pulp | 4.0 | 2.73 |
| Temperature, ° C | 65 | 66 |
| Time, min. | 90 | 120 |
| % Consistency | 9.0 | 10.0 |
| Residual Liquor pH | 12.0 | 11.0 |
| Calcium Hypochlorite Stage | | |
| % Hypo as Available $Cl_2$ on Pulp | 0.8 | 0.8 |
| Temperature, ° C | 35 | 32 |
| % Consistency | 8.5 | 7.0 |
| Time, min. | 90 | 120 |
| Residual Liquor pH | 9.2 | 9.0 |
| Results | | |
| Tappi Brightness (457 mn) | 70.2 | 68 |
| % Bleached Yield on Pulp | 95.0 | 93.0 |
| % Bleached Yield on Wood | 42.6 | 40.8 |

We claim:

1. In a process for pulping raw lignocellulosic material, the steps which comprise pretreating the lignocellulosic material with an aqueous solution containing from about 0.1 to 10% by weight of an aliphatic amine selected from monoethanolamine, methylamine and dimethylamine and thereafter subjecting the pretreated lignocellulosic material to digestion with sodium hydroxide alone at a sodium hydroxide application of at least 8% by weight expressed as sodium oxide based on the dry weight of said raw lignocellulosic material.

2. A process according to claim 1 wherein the pretreatment is conducted at an amine solution to lignocellulosic material weight ratio of from 1:1 to 10:1 at a temperature of 80° to 180° C for 5 to 120 minutes.

3. A process according to claim 2 wherein the pretreatment is conducted at a vessel pressure above ambient steam pressure of from 0 to 200 psi, the excess pressure being provided by an inert gas which does not react substantially with the pretreatment chemicals.

4. A process according to claim 3 wherein the digested lignocellulosic material is subjected to a second digestion with sodium hydroxide in the presence of an excess of oxygen.

5. A process according to claim 3 wherein the inert gas is nitrogen.

6. A process according to claim 1 in which the aqueous amine pretreatment liquor contains added alkali to adjust the cold pH of said liquor to a value of between 8 and 13.

7. A process according to claim 6 in which the added alkali is sodium hydroxide, added in an amount of from 0.2 to 10% by weight based on dry lignocellulosic material.

8. A process according to claim 6 in which the added alkali is sodium carbonate.

9. A process according to claim 1 in which the lignocellulosic material is wood chips.

10. A process according to claim 9 wherein the chips are softwood chips.

11. A process for pulping wood chips which comprises pretreating the chips with a solution of an aliphatic amine selected from monoethanolamine, methylamine and dimethylamine having a cold pH of about 8–13 at an application of about 5–10% by weight of amine based on bone dry wood, said pretreatment being conducted at a pretreatment liquor to wood weight ratio of about 4–5:1, at a temperature of about 120°–160° C and a time of about 30–60 minutes, thereafter draining excess liquor from the chips, subjecting the pretreated chips to digestion with sodium hydroxide alone at a sodium hydroxide application of at least 8% by weight expressed as sodium oxide based on the dry weight of the wood chips, defiberizing the thus treated material and then subjecting the defiberized material to a second digestion with sodium hydroxide in the presence of an excess of oxygen.

* * * * *